US011927076B2

(12) United States Patent
Karanikas et al.

(10) Patent No.: US 11,927,076 B2
(45) Date of Patent: Mar. 12, 2024

(54) GAS CONDENSATE REMOVAL HEATING SYSTEM

(71) Applicant: Salamander IP Holdings LLC, Hamilton (BM)

(72) Inventors: John Michael Karanikas, Houston, TX (US); Robert Guy Harley, Spring, TX (US); Guillermo Pastor, Tarragona (ES)

(73) Assignee: Salamander IP Holdings LLC, Hamilton (BM)

( * ) Notice: Subject to any disclaimer, the term of this patent is extended or adjusted under 35 U.S.C. 154(b) by 0 days.

(21) Appl. No.: 17/867,957

(22) Filed: Jul. 19, 2022

(65) Prior Publication Data

US 2023/0313643 A1 Oct. 5, 2023

Related U.S. Application Data

(60) Provisional application No. 63/326,309, filed on Apr. 1, 2022.

(51) Int. Cl.

| | |
|---|---|
| ***E21B 36/04*** | (2006.01) |
| ***E21B 47/07*** | (2012.01) |
| *E21B 36/00* | (2006.01) |
| *E21B 47/06* | (2012.01) |

(52) U.S. Cl.

CPC ..... *E21B 36/04* (2013.01); *E21B 47/07* (2020.05); *E21B 36/005* (2013.01); *E21B 47/06* (2013.01)

(58) Field of Classification Search

CPC .... E21B 36/005; E21B 36/04; E21B 41/0099; E21B 43/24; E21B 47/06; E21B 47/07

See application file for complete search history.

(56) References Cited

U.S. PATENT DOCUMENTS

| | | | | |
|---|---|---|---|---|
| 2,548,360 | A | 4/1951 | Germain | |
| 2,781,851 | A | 2/1957 | Smith | |
| 4,570,715 | A | 2/1986 | Van Meurs et al. | |
| 5,060,287 | A | 10/1991 | Van Egmond | |
| 2002/0023751 | A1 | 2/2002 | Neuroth et al. | |
| 2008/0185138 | A1* | 8/2008 | Hernandez-Solis | E21B 47/07 166/60 |
| 2012/0018167 | A1* | 1/2012 | Konopczynski | E21B 43/14 166/66 |
| 2016/0326839 | A1 | 11/2016 | Ayub et al. | |
| 2017/0298718 | A1* | 10/2017 | Mills | E21B 23/10 |

(Continued)

OTHER PUBLICATIONS

International Search Report and Written Opinion dated May 24, 2023 for PCT/EP2023/058409.

*Primary Examiner* — Tara Schimpf

*Assistant Examiner* — Lamia Quaim

(74) *Attorney, Agent, or Firm* — Jones Day

(57) ABSTRACT

A method of reducing condensate accumulation in a natural gas well may include a first step of determining a pressure and a temperature of the natural gas well. The method may further include a second step of determining a dew point temperature based on the pressure of the natural gas well. The method may also include a third step of determining a cricondentherm temperature of the natural gas well. The method may also include a fourth step of heating the natural gas well to a temperature above the dew point temperature; and a fifth step of limiting the temperature of the natural gas well to the cricondentherm temperature.

13 Claims, 6 Drawing Sheets

(56) References Cited

U.S. PATENT DOCUMENTS

| | | | | |
|---|---|---|---|---|
| 2020/0040666 | A1 | 2/2020 | Madrid et al. | |
| 2020/0173250 | A1 | 6/2020 | Carragher et al. | |
| 2021/0131228 | A1* | 5/2021 | Al-Driweesh ..... | E21B 43/2401 |
| 2021/0388701 | A1* | 12/2021 | Al Afnan ..... | H05B 6/109 |

* cited by examiner

GAS CONDENSATE REMOVAL HEATING SYSTEM

CROSS-REFERENCE TO RELATED APPLICATIONS

This application claims priority to U.S. Provisional Application No. 63/326,309, filed Apr. 1, 2022, which is incorporated herein by reference in its entirety.

FIELD

The present disclosure relates to natural gas wells.

BACKGROUND

A wellbore is a hole drilled into the earth to create a natural gas well. The well is used to access a natural gas reservoir. Production equipment is deployed in the natural gas well to transport natural gas from the natural gas reservoir to a wellhead. In conventional systems and methods, natural gas condensate can form on the interior of the production equipment. The condensate can disrupt the flow of the natural gas and decrease productivity. Therefore, systems and methods are needed to remove condensate from the production equipment and increase productivity.

SUMMARY

The foregoing discloses a method of reducing condensate accumulation in a natural gas well. In example embodiments of the present disclosure, the method includes determining a pressure and a temperature of the natural gas well. The method also includes determining a dew point temperature based on the pressure of the natural gas well. The method also includes determining a cricondentherm temperature of the natural gas well. The method also includes heating the natural gas well to a temperature above the dew point temperature and limiting the temperature of the natural gas well to the cricondentherm temperature.

The method described above may further comprise increasing the velocity of the natural gas exiting the natural gas well. The velocity of the natural gas may be increased by decreasing a cross-sectional area of the natural gas well. The cross-sectional area of the natural gas well may be decreased by inserting a heater cable into the natural gas well. In certain embodiments of the present disclosure, the natural gas well may be a vertical natural gas well, or the natural gas well may be a horizontal natural gas well.

The method may further include determining a first region of the natural gas well that comprises more condensate accumulation than a second region of the natural gas well. The second region may comprise a productive interval of the natural gas well. The method may further include heating the first region to a higher temperature than the second region. Heating the natural gas well may be achieved via a heater cable including a center conductor, an outer conductive sheath, and an insulating interior region. In some example embodiments, the insulating interior region comprises magnesium oxide. Heating the first region to a higher temperature than the second region may be achieved by altering the size of the portion of the heater cable deployed in the first region. In one example embodiment, heating the first region to a higher temperature than the second region is achieved by altering the materials of the center conductor, the outer conductive sheath, or the insulating interior region of the portion of the heater cable deployed in the first region.

The foregoing also describes a device. In some example embodiments, the device includes production tubing including a first end in an upper wellbore region of a natural gas well and a second end in a lower wellbore region of the natural gas well. The device may also include a Y-tool that comprises a first opening facing an upper wellbore region and a second opening coupled to an intersection of the first end of the production tubing and the second end of the production tubing. The device may also include an electrical submersible pump cable including a first region running adjacent to the first end of the production tubing and a second region running in the interior of the second end of the production tubing. The electrical submersible pump cable may enter the first opening of the Y-tool and may enter the second end of the production tubing through the second opening of the Y-tool. The device may also include a heater cable extending along the second end of the production tubing, the heater cable configured to reduce condensate in the natural gas well. The device may also include a controller coupled to the heater cable that is configured to increase the temperature of the natural gas well to a temperature above a dew point temperature and to limit the temperature of the natural gas well to a cricondentherm temperature.

The heater cable may further comprise a center conductor, an outer conductive sheath, and an insulating interior region. The center conductor may comprise a first non-heated region and a second heated region. The insulating interior region may comprise magnesium oxide. In some example embodiments, the device further includes an instrumentation tube located within the production tubing. The device may further comprise a seal assembly including a first end coupled to the Y-tool and a second end coupled to the second end of the production tubing, the seal assembly configured to prevent natural gas or condensate from escaping the production equipment.

BRIEF DESCRIPTION OF THE DRAWINGS

The following detailed description will be better understood when read in conjunction with the appended drawings. For the purpose of illustration, there is shown in the drawings certain embodiments of the present disclosure. It should be understood, however, that the invention is not limited to the precise arrangements and instrumentalities shown. The accompanying drawings, which are incorporated in and constitute a part of this specification, illustrate an implementation of systems and apparatuses consistent with the present invention and, together with the description, serve to explain advantages and principles consistent with the invention.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

It is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity and are not intended to limit the scope of the invention or the appended claims. Further, it should be understood that any one of the features can be used separately or in combination with other features. Other systems, methods, features, and advantages of the invention will be or become apparent to one with skill in the art upon examination of the detailed description. It is intended that all such additional systems, methods, features, and advantages be included within this description, be within the scope of the present invention, and be protected by the accompanying claims.

Figure 1:
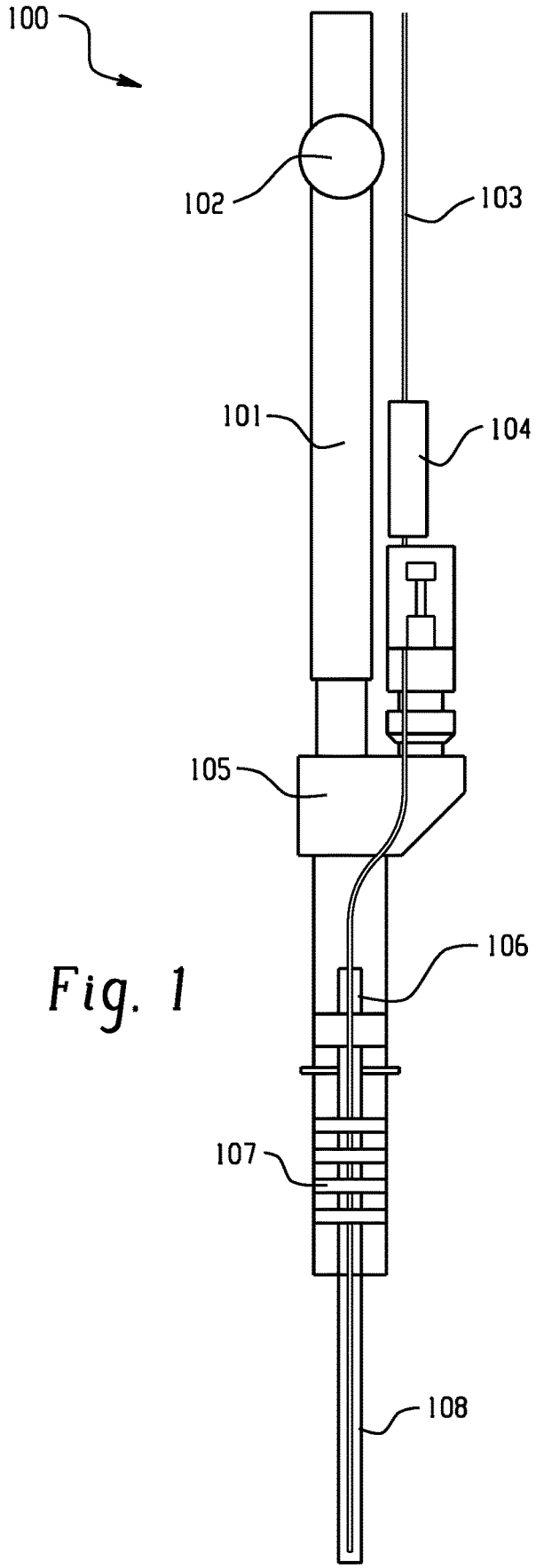
FIG. 1 depicts production equipment deployed in a natural gas well, in accordance with some embodiments.

FIG. 1 depicts production equipment 100 deployed in a natural gas well 100, in accordance with some embodiments. In the example embodiment demonstrated in FIG. 1, the production equipment 100 includes an upper production tubing component 101, a surface-controlled subsurface safety valve ("SCSSV") 102, a Y-tool 105, an electrical submersible pump cable 103, a triskellion 104, a coiled tube hanger 106, a seal assembly 107, and a lower production tubing component 108. The production equipment 100 may be deployed in horizontal wells or vertical wells in differing embodiments of the present disclosure. In the example depicted in FIG. 1, the production equipment 100 is deployed in a wellbore of a natural gas well. The upper and lower components (101, 108) of the production tubing are used to transport natural gas from a natural gas reservoir to a wellhead. The SCSSV 102 is a valve (e.g., a failsafe valve) that is used to protect equipment within the wellbore. The SCSSV 102 can automatically actuate when pressure accumulation could result in damage to the equipment or even to prevent explosions. For example, the SCSSV 102 may automatically actuate and discharge fluid when the pressure on the inlet side of the valve increases to a predetermined pressure. Thus, the SCSSV 102 may be connected to a controller.

The triskellion 104 can provide for an attachment of electrical conductors of a standard electrical submersible pump cable to a heater cable (e.g., a mineral insulated heater cable) for use in oil and gas wells. Electrical submersible pump cables are used to power or control electrical submersible pumps, which are pumps that are used to increase fluid pressure within a natural gas well to draw natural gas from an inlet section within a wellbore to a wellhead so that the natural gas can be used for various purposes. The attachment may be provided by conductively joining one or more of the electrical conductors of the electrical submersible pump cable to a cold lead of the heater cable within an insulated sleeve covered and sealed within a protective cover. The joined heater cable and electrical submersible pump cable can then be lowered into the wellbore to a desired location and can be attached to the production tubing 101. For example, clamps or straps may be used to attach the cables to the production tubing 101. In some example embodiments, connectors other than the triskellion 104 can be used for joining an electrical submersible pump cable to a heater cable.

The Y-Tool 105 is coupled to the triskellion 104 or another suitable connector and the upper production tubing component 101 and can be used to deploy two electrical submersible pump cables into the same well. In some example embodiments, the Y-Tool 105 is omitted from the production equipment 100, and the electrical submersible pump cables simply run along the interior of the production tubing (101, 108) or run along the outside of the production tubing (101, 108).

The coiled tube hanger 106 is coupled to the Y-tool 105 and is used to support coiled tube heaters that are deployed in natural gas wells. As described further with respect to FIGS. 2 and 3, the heaters (e.g., coiled tube heaters) can be used to reduce or eliminate the amount of condensate that accumulates within the production tubing (101, 108) of a natural gas well. The seal assembly 107 is coupled to the coiled tube hanger 106 and is used to seal the coiled tube hanger 106 to the lower production tubing component 108 and prevent natural gas or condensate from escaping from the production equipment 100. In some example embodiments of the present disclosure, the heaters are used to heat the production tubing within the wellbore region of the natural gas well. In other example embodiments, the heaters are used to propagate a temperature front to a bulk of the reservoir. For example, the heaters can be extended through the production tubing into a productive interval of the natural gas well. Heating of this productive interval may cause a condensate front within the productive interval to move further into the productive interval and further away from the wellbore region. This may assist in suppressing liquid drop-off as the natural gas expands and cools when it first enters the wellbore region. The heaters may also be used to heat the well and flowlines in other settings that are within the spirit and scope of the present disclosure.

Figure 2:
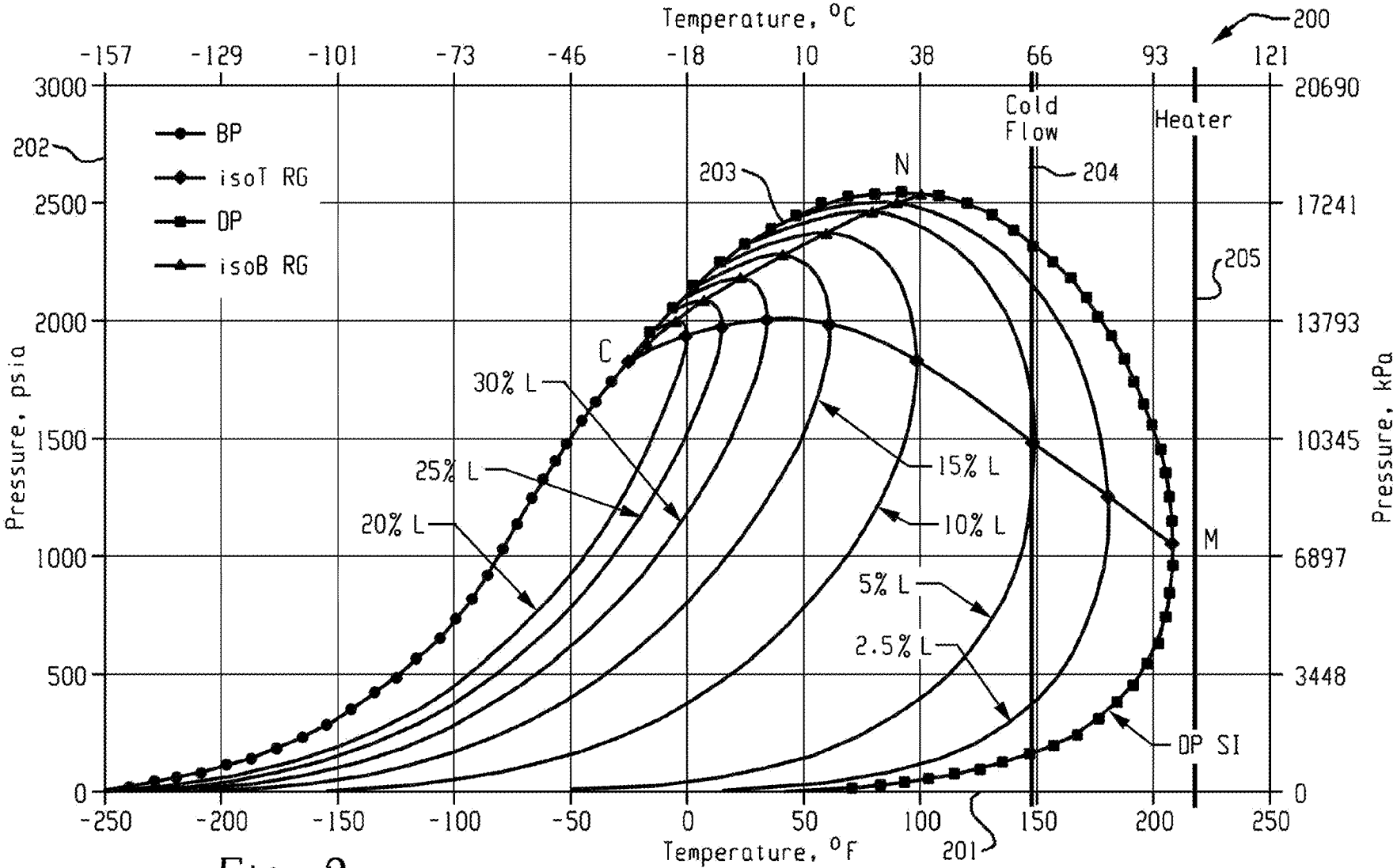
FIG. 2 shows a typical phase diagram for a multicomponent natural gas mixture, in accordance with some embodiments.

FIG. 2 shows a typical phase diagram for a multi-component natural gas mixture 200, in accordance with some embodiments. In the example embodiment depicted in FIG. 1, the characteristics of a two-phase natural gas and natural gas condensate mixture at various temperatures and pressures are represented by the enclosed envelope 203 of the graph 200. The horizontal axis 201 represents the temperature in a wellbore region in degrees Fahrenheit. The vertical axis 202 in the graph 200 of FIG. 2 represents the pressure in the wellbore region in pounds per square inch (PSI). It should be appreciated by one of ordinary skill in the art that the graph of FIG. 2 may be represented with differing characteristics, units, or numerical values while still being within the spirit and scope of the present disclosure. The graph of FIG. 2 is an example embodiment used to illustrate important concepts of the present disclosure.

The cold flow temperature line 204 and the heater temperature line 205 of the graph 200 illustrate how increasing the wellbore region temperature can prevent condensate dropout in the reservoir. Condensate may be initially present in the wellbore region due to expanding and cooling after flowing up production tubing within the wellbore region. For example, natural gas can condense to a liquid state if the temperature of the natural gas is reduced below a given dew point at a set pressure. However, appropriate measures can be taken to reduce or eliminate the condensate from the production tubing. This can be accomplished, for example, by inserting a heater into the production tubing. The heater may be a coiled-tubing heater. In the example embodiment shown in FIG. 2, the cold flow temperature is approximately 150 degrees Fahrenheit and the temperature with the heater employed is approximately 220 degrees Fahrenheit.

At pressures that result in a two-phase mixture at 150 degrees Fahrenheit (e.g., pressures within the two-phase envelope at 150 degrees Fahrenheit), increasing the heat sufficiently will eliminate or substantially reduce the natural gas condensate from the two-phase mixture. The result is that simply natural gas remains in the production tubing surrounding the heater. The heater can be controlled such that the temperature within the production tubing is increased to a level that eliminates or substantially reduces liquid buildup, while limited to not exceed a level that results in significant unnecessary power consumption. For example, the temperature within the production tubing can be limited to not exceed a minimum temperature at which hydrocarbons deposit solid organic residue within the production tubing. At such a temperature, the solid organic residue can inhibit natural gas flow.

Inserting a heater (e.g., a coiled tube heater) into production tubing can also assist in preventing condensate accumulation by increasing the velocity of the natural gas flowing up the production tubing. A heater occupies space in the production tubing. Therefore, the cross-sectional area that is available for natural gas to flow in the production tubing is reduced when the heater is present. Thus, the velocity of the natural gas naturally increases to maintain the same volume of flow that is present without the heater. This phenomenon can maintain a velocity of the natural gas that is above a predefined level (e.g., a critical rate) that is necessary to prevent liquid accumulation.

Figure 3:
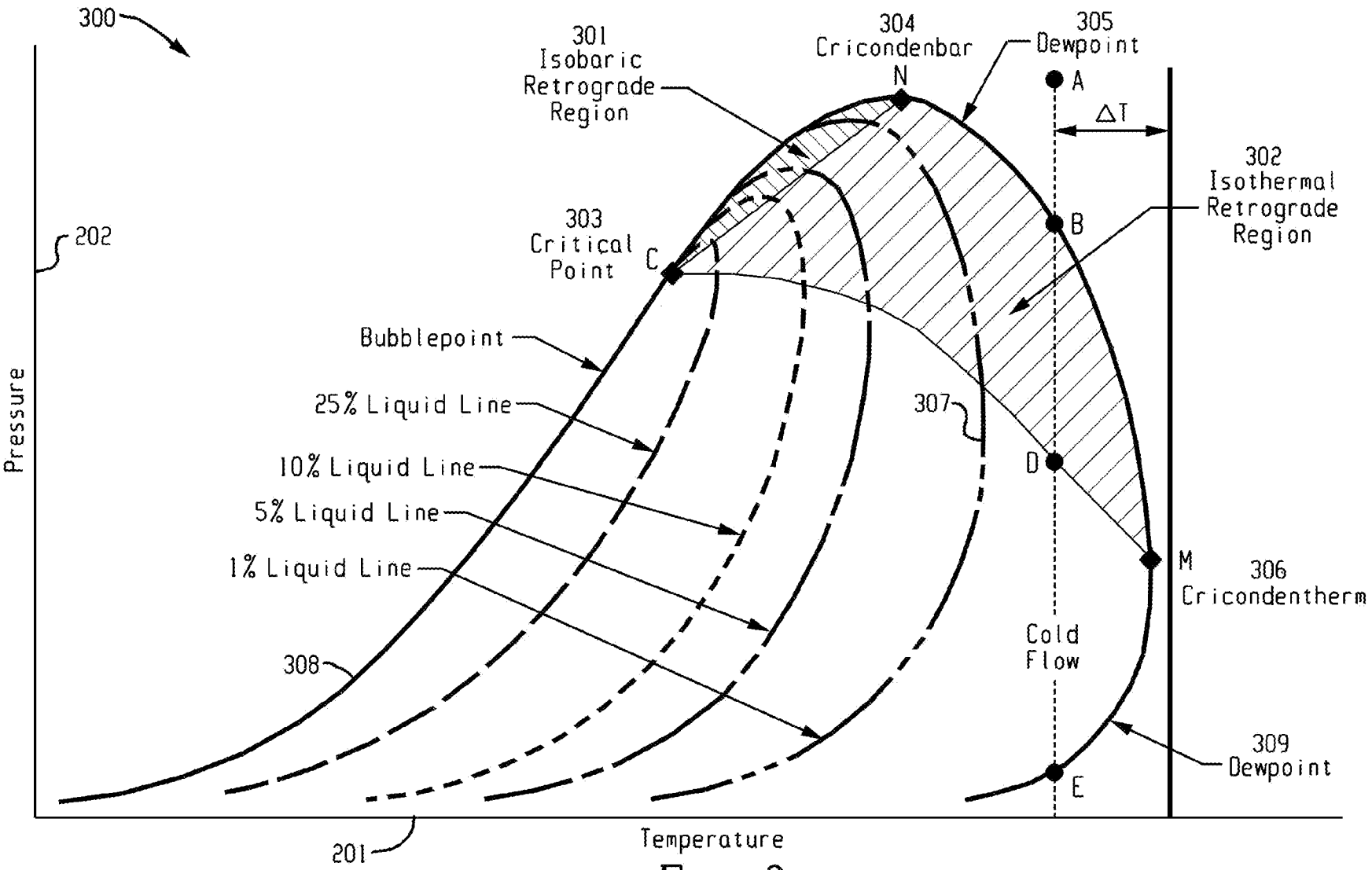
FIG. 3 shows a detailed phase diagram for a multicomponent natural gas mixture with labeled regions, in accordance with some embodiments.

FIG. 3 shows a detailed phase diagram 300 for a multi-component natural gas mixture with labeled regions, in accordance with some embodiments. The parameters illustrated in the graph of FIG. 3 can be obtained by appropriate computer software. FIG. 3 illustrates an isobaric retrograde region 301. An isobaric retrograde region 301 is a region wherein, at constant pressure, vapor is condensed by an increase in temperature. FIG. 3 also illustrates an isothermal retrograde region 302. An isothermal retrograde region 302 is a region wherein, at constant temperature, the vapor phase in contact with liquid may be condensed by a decrease in pressure. As depicted in FIG. 3, retrograde condensation (301, 302) occurs in two-phase natural gas streams at relatively high pressures. Also shown in FIG. 3 is a cricondentherm temperature 306. A cricondentherm temperature 306 is the highest temperature at which liquids and gasses can coexist. Similarly, a cricondenbar pressure 304 is the highest pressure at which liquids and gasses can coexist. The various dashed lines within the two-phase envelope represent temperatures and pressures at which consistent liquid natural gas condensate levels are sustained in the two-phase natural gas and condensate mixture. For example, at the temperatures and pressures at the points along the dashed line 307 labeled, "1% liquid line," the two-phase natural gas and condensate mixture comprises approximately 1% liquid condensate. At temperatures below the "bubblepoint" region 308, a two-phase mixture does not exist. Instead, only natural gas condensate exists. In contrast, at temperatures above the dew point region 309, natural gas exists with very little or no condensate present.

Another notable temperature level not illustrated in FIG. 3 is a coking temperature, which is a minimum temperature at which hydrocarbons (e.g., natural gas) can deposit solid organic residue ('coke') within the production tube (101, 108). This solid organic residue may inhibit the flow of natural gas. The coking temperature may be approximately 250 degrees Celsius (482 degrees Fahrenheit), depending in part on the density of the fluid of the particular application. This coking temperature, independently or in conjunction with the cricondentherm temperature 306, can be used to strategically heat the production tube (101, 108) to a preferred level that minimizes liquid buildup while avoiding excess power consumption. For example, the heater can be used to heat the temperature within the production tube (101, 108) to a level that is greater than the dew point temperature, while limited to not exceed the coking temperature. As another example, the heater can be used to heat the temperature within the production tube (101, 108) to a level that is greater than the cricondentherm temperature 306, while limited to not exceed the coking temperature.

Figure 4:
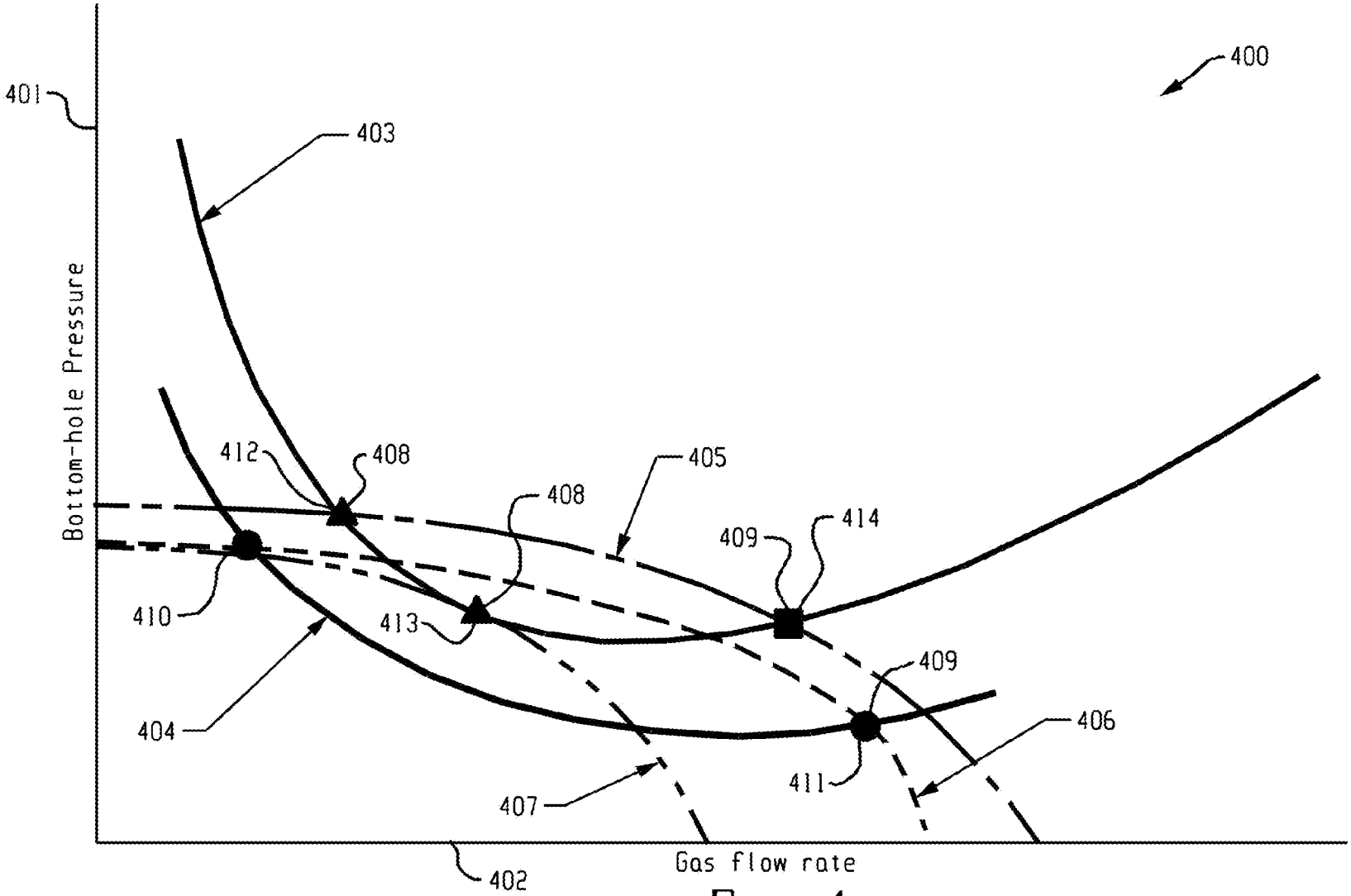
FIG. 4 shows a graph representing the relationship between bottom-hole pressure and the natural gas flow rate, in accordance with some embodiments.

FIG. 4 shows a graph 400 representing the relationship between bottom-hole pressure 401 and the natural gas flow rate 402, in accordance with some embodiments. The bottom-hole pressure is the pressure at the bottom of the wellhole. It is equal to the pressure trop in the tubing plus the wellhead pressure. Referring to the example graph of FIG. 4, the natural gas flow rate 402 can be determined based on the intersection of a tubing performance curve ("TPC") (403, 404) and a reservoir inflow performance relationship ("IPR") (405, 406, 407). The TPC (403, 404) is a plot of a surface production rate for a specific tubing size and fluid composition at various bottom hole pressures. The IPR (405, 406, 407) is a plot of a natural gas well flow rate 402 at various bottom hole pressures 401. In some operating conditions, the TPC (403, 404) and IPR (405, 406, 407) intersect at two points. In these instances, the right intersecting point 409 in the graph of FIG. 4 may be a stable operating point. In contrast, the left intersecting point 408 may be a relatively unstable operating point. At the unstable operating point, small variations in tubing pressures can cause unstable flow conditions with large variations.

In an unheated natural gas well, the production rate can initially be determined by the intersection of a first IPR 405 and a first TPC 403 at point 414. Over time, the reservoir pressure may decline. This can result in the characteristic IPR moving to a second IPR 407, which intersects the first TPC 403 at point 413. This can result not only in a reduction in the natural gas flow rate compared with point 414 but also unstable flow (e.g., slugging). This can eventually result in the natural gas well ceasing to flow (e.g., no TPC and IPR intersection).

Inserting a coiled tube heater into production tubing can result in a dual inflow and outflow benefit. The IPR of the natural gas well can be improved due to the coiled tube heater reducing condensate accumulation around the wellbore. For example, this may result in an IPR of the natural gas well improving from the second IPR 407 to a third IPR 406. In addition, the TPC can be improved by a reduction in flow area due to the coiled tube heater occupying space within the production tubing. The combined effect may be that the IPR and TPC will intersect at point 411 rather than point 413. As discussed above, this operating point is indicative of a larger and more stable natural gas flow rate.

Figure 5:
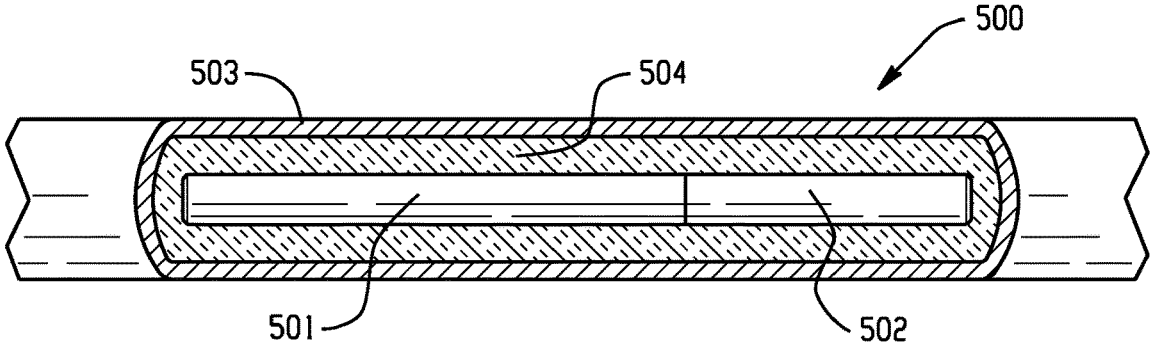
FIG. 5 shows a heater cable, in accordance with some embodiments.

FIG. 5 shows a heater cable 500, in accordance with some embodiments. In the example depicted in FIG. 5, the heater cable 500 includes a center conductor including a non-heated section 501 and a heated section 502, an outer sheath 503, and an insulating interior 504. The heater cable 500 is capable of injecting more power due to improved insulation 504 between the center conductor (501, 502) and the outer sheath 503. In the example embodiment depicted in FIG. 5, the improved insulation 504 between the center conductor (501, 502) and outer sheath 503 is magnesium oxide. In various applications in which it is advantageous to vary the heat output along the length of the heater cable, core materials or cable size can be modified inline using internal splice technology. For example, in some applications condensate in a natural gas well may form more at lower regions of the wellbore. Therefore, core materials or cable size may be strategically employed such that more heat output is present at these lower regions than at upper regions.

In the example depicted in FIG. 5, the non-heated section 501 comprises a material (e.g., copper) that does not emit significant levels of heat when energized, compared with the material of the heated section 502, which may be a material such as a copper-nickel alloy. By varying the material composition along the length of the heater cable 500, heat dissipation can be controlled at various regions of the wellbore. This can save costs associated with unnecessarily heating regions of the wellbore that contain little or no condensate.

Figure 6A:
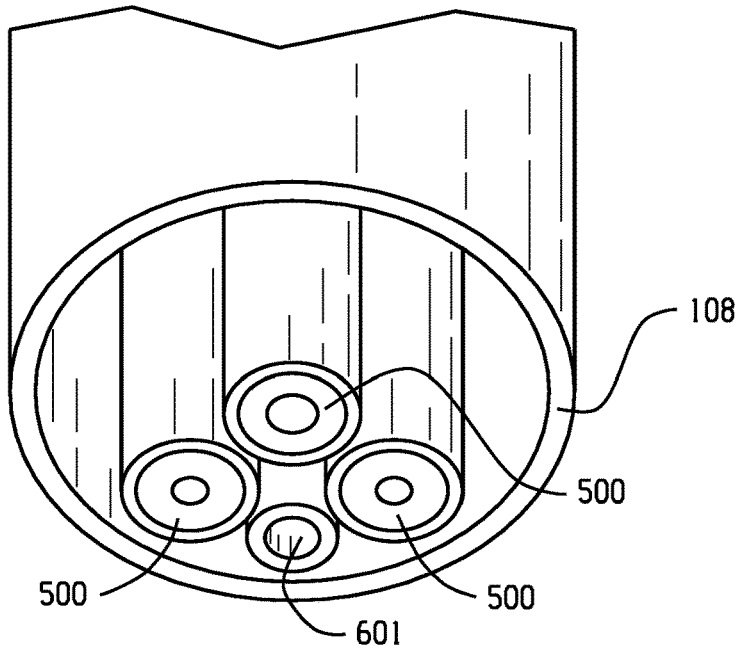
FIG. 6A depicts an interior view of production tubing within a natural gas well, in accordance with some embodiments.

FIG. 6A is an interior view of production tubing (101, 108) within a natural gas well, in accordance with some embodiments. In the example embodiment shown in FIG. 6A, three heater cables 500 are shown, as well as an instrumentation tube 601. While three heater cables 500 are show in the example embodiment of FIG. 6A, more or less heater cables 500 may be employed in other embodiments of the present disclosure. The instrumentation tube 601 can be used to deploy various instruments into the well of the present disclosure. These instruments can be used to provide data that is used for controlling the heat output of the heater cables 500. For example, a thermocouple can be placed in the instrumentation tube 601 that can be fed to a controller. The thermocouple can be utilized by the controller to determine the power that is necessary to deliver to the heater cables to maintain a proper temperature within the production tubing. For example, the power delivered to the heater cables 500 can be varied from 0-100% of their maximum value. The instrumentation tube 601 may also be used to contain other forms of instrumentation, such as fiber optic cables, silicon diodes, or pressure sensors. This instrumentation may be used to control the heater output of the heater cables 500, or may be used for other purposes in various embodiments of the present disclosure. The instrumentation tube 601 may also be placed outside of the production tube (101, 108).

Figure 6B:
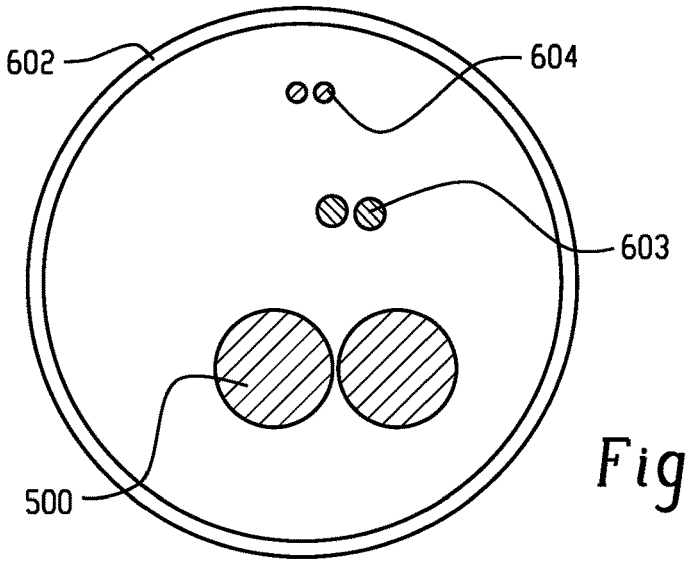
FIG. 6B depicts instrumentation and heater cables deployed in a natural gas well, in accordance with some embodiments.

FIG. 6B depicts instrumentation and heater cables deployed in a natural gas well, in accordance with some embodiments. In the example embodiment depicted in FIG. 6B, heater cables 500, a thermocouple 604, and a fiber optic cable 603 are deployed. The tube 602 in which the heater cables and instrumentation are deployed may be the production tube (101, 108) or may be the instrumentation tube 601, in differing embodiments that are within the spirit and scope of the present disclosure. The thermocouple 604 may be connected to a controller, for example, that can be used to alter the power delivered to the heater cables 500 based on the temperature that is determined by the thermocouple 604. The fiber optic cable 603 may be utilized for various forms of data transmission or control of transducers or instrumentation within the wellbore. Other forms of instrumentation may be deployed in the production tube (101, 108) or instrumentation tube 601 in embodiments that are within the spirit and scope of the present disclosure.

Figure 7:
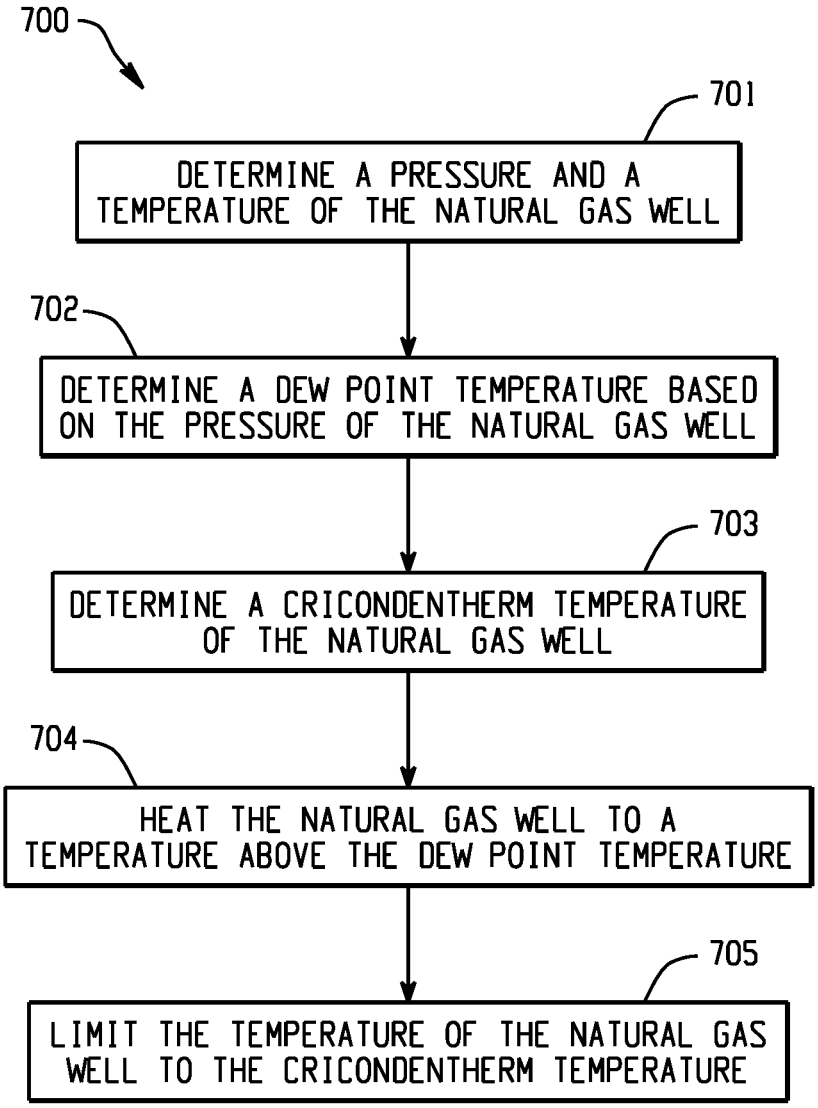
FIG. 7 depicts a method of reducing condensate accumulation in a natural gas well, in accordance with some embodiments.

FIG. 7 depicts a method of reducing condensate accumulation in a natural gas well 700, in accordance with some embodiments. The method 700 includes a first step 701 of determining a pressure and a temperature of the natural gas well. The method 700 includes a second step 702 of determining a dew point temperature based on the pressure of the natural gas well. The method 700 also includes a third step 703 of determining a cricondentherm temperature of the natural gas well. The method 700 also includes a fourth step 704 of heating the natural gas and well to a temperature above the dew point temperature. The method 700 also includes a fifth step 705 of limiting the temperature of the natural gas well to the cricondentherm temperature. In some example embodiments that are within the spirit and scope of the present disclosure, the steps depicted in FIG. 7 may be performed in a different order than that described above. Furthermore, steps may be omitted from the example embodiment depicted in FIG. 7 while remaining within the spirit and scope of the present disclosure.

It will be appreciated by those skilled in the art that changes could be made to the embodiments described above without departing from the broad inventive concept thereof. It is understood, therefore, that the invention disclosed herein is not limited to the particular embodiments disclosed, and is intended to cover modifications within the spirit and scope of the present invention.

What is claimed is:

1. A method of reducing condensate accumulation in a natural gas well comprising:

determining, by a pressure sensor, a pressure of the natural gas well;

determining, by a temperature sensor, a temperature of the natural gas well;

determining a dew point temperature based on the pressure of the natural gas well;

determining a cricondentherm temperature of the natural gas well;

heating, by controlling power delivered to a heater cable, the natural gas well to a temperature above the dew point temperature; and preventing, by controlling the power delivered to the heater cable, the temperature of the natural gas well from exceeding the cricondentherm temperature.

2. The method of claim 1, further comprising increasing a velocity of natural gas exiting the natural gas well.

3. The method of claim 2, wherein the velocity of the natural gas is increased by decreasing a cross-sectional area of the natural gas well.

4. The method of claim 3, wherein the cross-sectional area of the natural gas well is decreased by inserting the heater cable into the natural gas well.

5. The method of claim 4, wherein the natural gas well is a vertical natural gas well.

6. The method of claim 4, wherein the natural gas well is a horizontal natural gas well.

7. The method of claim 4, further comprising determining a first region of the natural gas well that comprises more condensate accumulation than a second region of the natural gas well.

8. The method of claim 7, wherein the second region comprises a productive interval of the natural gas well.

9. The method of claim 8, further comprising heating the first region to a higher temperature than the second region.

10. The method of claim 9, wherein heating the natural gas well is achieved by the heater cable including a center conductor, an outer conductive sheath, and an insulating interior region.

11. The method of claim 10, wherein the insulating interior region comprises magnesium oxide.

12. The method of claim 11, wherein heating the first region to a higher temperature than the second region is achieved by altering the size of the portion of the heater cable deployed in the first region.

13. The method of claim 11, wherein heating the first region to a higher temperature than the second region is achieved by altering the materials of the center conductor of the portion of the heater cable deployed in the first region.

* * * * *